US005147267A

United States Patent [19]

Kunewalder

[11] Patent Number: 5,147,267

[45] Date of Patent: Sep. 15, 1992

[54] EXERCISE AID

[76] Inventor: Anthony P. Kunewalder, 2700 N. Cahuenga, #4319, Los Angeles, Calif. 90068

[21] Appl. No.: 595,551

[22] Filed: Oct. 11, 1990

[51] Int. Cl.[5] ..... A63B 26/00

[52] U.S. Cl. ..... 482/142; 482/907; 482/96

[58] Field of Search ..... 272/93, 144, 903; 128/68, 69

[56] References Cited

U.S. PATENT DOCUMENTS

| | | | |
|---|---|---|---|
| 4,848,742 | 7/1989 | Lindley et al. | 272/144 |
| 4,902,003 | 2/1990 | Buoni | 272/93 |
| 4,979,732 | 12/1990 | Rashatz et al. | 272/93 |

FOREIGN PATENT DOCUMENTS

| | | | |
|---|---|---|---|
| 3326078 | 1/1985 | Fed. Rep. of Germany | 272/144 |
| 481656 | 1/1970 | Switzerland | 272/144 |

*Primary Examiner*—Richard J. Apley
*Assistant Examiner*—D. F. Crosby
*Attorney, Agent, or Firm*—Roy A. Ekstrand

[57] ABSTRACT

A buttocks exerciser is formed of a one-piece housing having a generally planar upper surface and rectangular configuration. The exerciser further defines a concave undersurface and a triangular cross-section pivot support extending downwardly beneath the headrest portion. The pivot support terminates in a transversely extending pivot edge about which the exerciser pivots. A pair of fastening belts are secured to the lower portion of the exerciser and are movable for position adjustment. The user places his or her torso upon the exercise with head overlying the headrest and hips near the bottom edge. The user then fastens the attachment straps across the user's lap and hip portion and thereafter, with feet placed near the bottom edge, performs a wrestler's bridge-type exercise in which the exerciser pivots about the transverse pivot edge.

8 Claims, 3 Drawing Sheets

EXERCISE AID

FIELD OF THE INVENTION

This invention relates generally to exercise equipment and particularly to those directed at exercising the lower back and buttocks muscles.

BACKGROUND OF THE INVENTION

The recent surge of interest in fitness and health which has swept much of the United States as well as a number of countries throughout the world has generated great interest in physical exercise and equipment used in conjunction therewith. One of the more dramatic trends in such exercise equipment has been the departure from exercise equipment and devices which tone the overall body generally in favor of apparatus which specializes in or is directed to a targeted body area or muscle group. To meet this need practitioners in the art have produced a variety of exercise devices, many of which operate as relatively complex mechanical mechanisms utilizing traveling weights for resistance and multiple cable and pulley systems to couple the body motion to the resistance weights. Most of such equipment is relatively elaborate and has thus far been developed and used primarily in commerical settings such as spas, health clubs, athletic training rooms and the like. Manufacturers have attempted to provide lower costs multiple use replicas of such commercial apparatus or use in a noncommercial or home setting. However, notwithstanding these attempts, most equipment has remained relatively complex. One of the more uncomplicated and relatively direct exercise devices to have emerge in recent years which is directed at specific muscle group is embodied in a product manufactured and marketed under the trademark Abdomenizer which has enjoyed great success and which is directed at strengthening the frontal abdominal muscles of the user. This device comprises a generally curved member having a concave upper surface and a corresponding concave lower surface together with upwardly extending side portions. The user positions his or her self within the device in a sitting position upon the concave surface and resting upon the convex surface. Thereafter, the legs are extended usually touching the floor while the abdomen is curled and the user's body assumes a slightly upward seated position. Once so positioned, the user simply rocks back and forth across the convex outer surface and in so doing exercises the abdominal muscles.

One exercise need which has not been effectively addressed here to date is the need for a simple device for exercising the lower back and buttocks muscle groups. While the above-mentioned commercial health club equipment does permit the exercise of such muscle groups, its high cost, cumbersome size and difficulty of use renders it less accessible than desired for the average exercise enthusiast.

Therefore, there arises a need in the art for an inexpensive, uncomplicated and easy to use exercise device which is directed at strengthening the lower back and buttocks muscles of the user.

SUMMARY OF THE INVENTION

Accordingly, it is a general object of the present invention to provide an improved exercise aid. It is a more particular object of the present invention to provide an improved exercise aid which strengthens the lower back and buttocks muscles of the user. It is a still more particular object of the present invention to provide an improved exercise aid directed at strengthening the lower back and buttocks muscles of the user which is relatively inexpensive and uncomplicated and which stores easily.

In accordance with the present invention, there is provided for use in exercising the buttocks and lower back muscles of a human, an exercise aid comprises: a generally planar portion having a generally concave lower surface and an ergonometric upper surface; a pivot portion extending downwardly from the lower surface; and a securing belt secured to the side edge portion of the planar portion; the exercise aid being operable by a user lying on his or her back on the upper surface with feet drawn close to the buttocks. Thereafter, the user raises hips upwardly to assume a "bridged" position as the planar portion pivots about the pivot portion.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENTS

Figure 1:
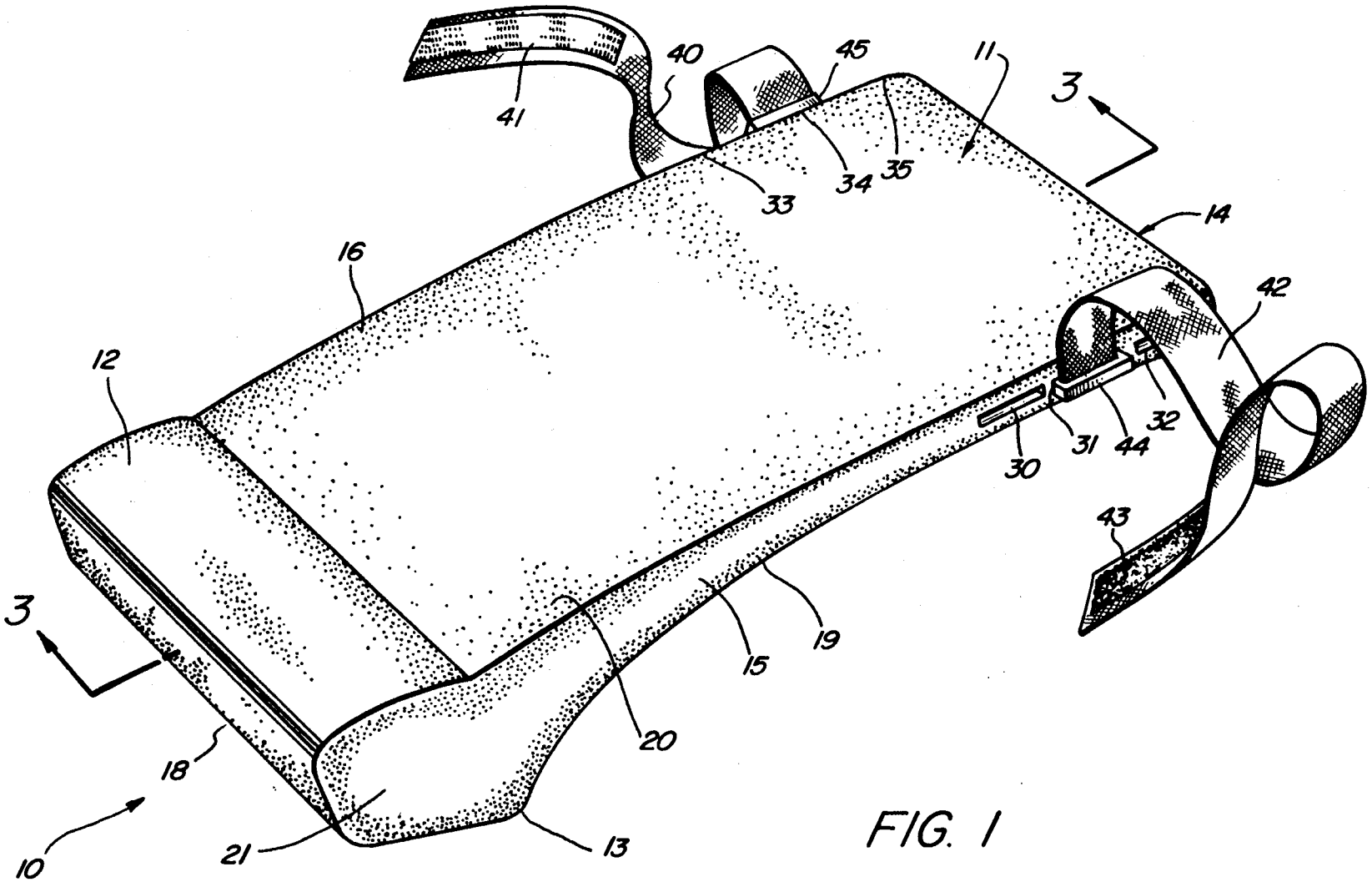
FIG. 1 sets forth a perspective view of the present invention exercise aid.

FIG. 1 sets forth a perspective view of an exerciser constructed in accordance with the present invention and generally referenced by numeral 10. Exerciser 10 includes a multiply curved body portion 11 defining a generally planar upper surface 20 and a concave curved undersurface 19. Body portion 11 further defines a pair of generally side portions 15 and 16, a bottom edge 17 and a top edge 18. A head rest 12, preferably formed of a comfortable material, extends along top edge 18 and inwardly therefrom to cover a portion of upper surface 20. Body portion 11 further defines a downwardly extending pivot support 21 which terminates in a transversely extending pivot edge 13. Upper surface 20 may be formed in a generally planar configuration. However, it has been found advantageous to conform upper surface 20 to a gently ergonomic shape selected to conform generally to the upper body of a human user. Side 15 defines a plurality of rectangular slots 30, 31 and 32. As is better seen in FIG. 2, side 16 forms a corresponding plurality of rectangular slots 33, 34 and 35.

A snap bracket 44 is configured to be engageably received within a selected one of slots 30, 31 or 32. Bracket 44 supports a flat generally flexible belt 42 formed of a strong material similar to automotive seat belts. Belt 42 further includes an attachment pad 43 which, in its preferred form, comprises one element, a fabric hook and loop attachment pad such as that marketed under the trademark Velcro. Similarly, a snap bracket 45 is configured to be received in an engageable attachment within a selected one of slots 33 through 35 of side 16. Belt 40 is formed of a similar flexible material to belt 42 and defines an attachment pad 41 at the end portion thereof. Attachment pad 41, in its preferred form, comprises the complimentary member of a hook and loop fabric attachment to cooperate with pad 43 of belt 42. As will be apparent from examination of the figures below, belts 40 and 42 are wrapped about the lower torso of the user and are used to partially secure the user's torso to body portion 11 of exerciser 10. Accordingly, it should be understood that pads 41 and 43 are supported on overlying sides of belts 42 and 40 when placed in overlying or overlapping position upon the user's lower torso.

Figure 2:
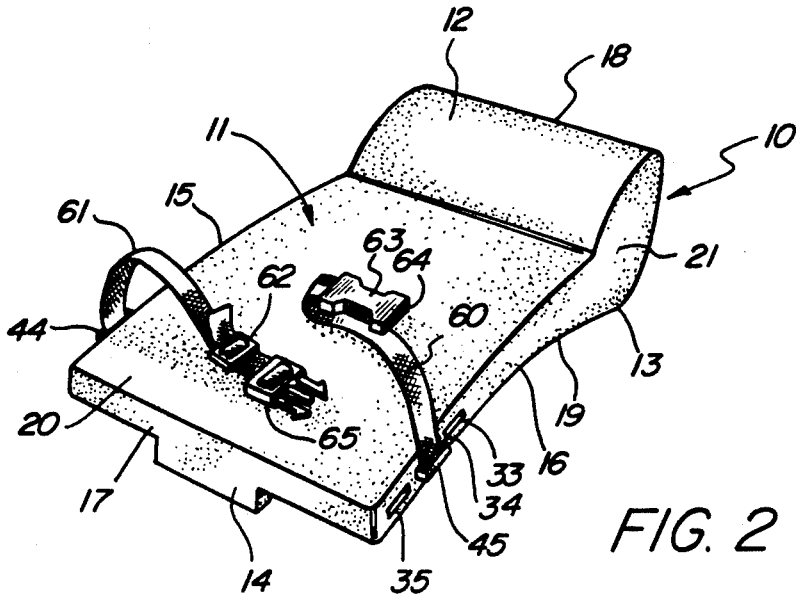
FIG. 2 sets forth a perspective view of an alternate embodiment of the present invention exercise aid.
Figure 2A:
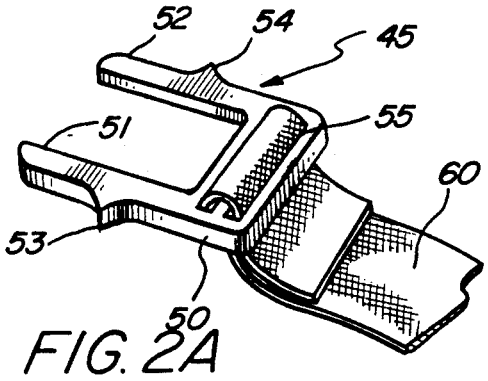

Body portion 11 of exerciser 10 further defines a downwardly extending lower stop 14 (better seen in FIG. 2). Stop 14 is selected to position the angle of exerciser 10 in the rest or lowered position shown below. It will be apparent to those skilled in the art that different heights and widths of lower stop 14 may be utilized to provide the desired angle in the rest position and the desired stability in cooperation with pivot edge 13 to properly support the user in a comfortable manner.

Thus, in accordance with the operation of exerciser 10 set forth below in greater detail, the user positions his or her upper body upon upper surface 20 of exerciser 10 such that the user's torso is supported from approximately mid-neck across the shoulders and back to the mid-buttocks area. The exact position of the user upon exerciser 10 will, of course, be a matter of adjustment by the user to suit the user's particular exercise needs and physiology. Thereafter, the user fastens straps 40 and 42 by overlapping across the lower torso or lap portion of the user's body such that pads 41 and 43 are brought into contact and pressed together to form a secure attachment. The user next places both hands either on the floor or grasps the edges of exerciser 10 along sides 15 and 16 near the bottom end portion of exerciser 10. The user then places his or her feet flat on the floor with the heels thereof as close to bottom edge 17 as comfort permits. In the exercise mode once this position has been attained, the hips are thrust upward while the user simultaneously force downwardly upon the floor with his or her feet causing exerciser 10 to pivot about pivot edge 13 and simultaneously raise the user's hips and lower the user's head. In the fully extended position, the user's body assumes a general position similar to the exercise position known as "wrestler's bridge". However, due to the inventive structure of exerciser 10, the stress and discomfort of the neck, head and shoulders generally associated with such exercises is completely avoided. The shape of exerciser 10 permits the full stressing and therefore exercise benefits of the gluteus or buttocks muscles providing substantial exercise benefit. It should be noted that, in accordance with the operation set forth below, the present invention exerciser facilitates use by persons of a wide degree of physical condition. Persons in extremely good shape and having substantial flexibility and limber physiques may fully extend in the raised position. Conversely, individuals having limited flexibility and mobility or in less than optimum physical condition may start slowly with relatively shallow extensions and gradually condition and increase their capability.

In any event, the repetitive exercise of raising and lowering the buttocks and lower torso described below allows the user to substantially strengthen and tone the buttocks or gluteus muscle group. During the exercise, the support and attachment of straps 40 and 42 provides a dual benefit of maintaining the user's position upon the exerciser and maintaining the continuous contact between the user and upper surface 20 of exerciser 10 during the entire exercise cycle.

FIG. 2 sets forth a perspective view of an alternate embodiment of exerciser 10. As will be apparent to those skilled in the art by comparison of FIG. 1 and FIG. 2, the embodiment of exerciser 10 shown in FIG. 2 is substantially the same as the embodiment as FIG. 1 with the exception of the type of attaching belt used. Accordingly, exerciser 10 as shown in FIG. 2 includes a body portion 11 having a generally planar structure with a planar upper surface 20 and concave undersurface 19. Parallel sides 15 and 16 define respective pluralities of slots 30 through 32 and 33 through 35. Body 11 further defines bottom edge 17 having a downwardly extending lower stop 14. A headrest 12 extending transversely across body portion 11 and defines a top edge 18. Body 11 further defines a downwardly extending generally triangular pivot support 21 having a transversely extending pivot edge 13.

A pair of generally flat flexible belts 60 and 61 are removably secured within selected ones of slots 30 through 35 in the manner set forth above for belts 40 and 42. A snap bracket 45 is secured to one end of belts 60 and 61 and defines a generally U-shaped member 50 preferably formed of a resilient molded plastic material or the like. U-shaped member 50 forms a spring clip having a channel 55 for receiving the end portion of one of belts 40, 42, 60 or 61 in a conventional attachment such as sewing or adhesive attachment. U-shaped member 50 defines a pair of resilient elongated tines 51 and 52 having outwardly extending lock tabs 53 and 54 respectively. Bracket 45 is constructed in accordance with conventional fabrication techniques and thus is received within a selected one of slots 33 through 35 of body portion 11. Belts 60 and 61 support a conventional buckle combination formed of a clasp 63 and a latch 65. Clasp 63 defines an elongated slot 64 which receives latch 65 in a snap-fit attachment which secures belts 60 and 61 to the user in the manner set forth above in FIG. 1. Thus, belts 60 and 61 having clasp 63 and latch 65 provide an alternative attachment means for use in the same manner described above for belts 40 and 42. Belt 61 further supports a conventional adjustment clip 62 which permits the position of latch 65 upon belt 61 to be adjusted to suit the user's lap dimension.

In all other respects, the embodiment shown in FIG. 2 is identical to that shown in FIG. 1 with the exception of clasp 63 and latch 65 together with adjustment clip 62. Thus, the user may select between either form of adjustment to suit convenience. It should be noted that while three slots are shown in sides 15 and 16 of body portion 11 respectively and thus three different positions for belts 40 and 42 or belts 60 and 61 may be provided to suit the user's comfort, it will be apparent to those skilled in the art that additional slots may be provided to achieve a greater number of alternative positions for the fastening belts of exerciser 10 without departing from the spirit and scope of the present invention.

Figure 3:
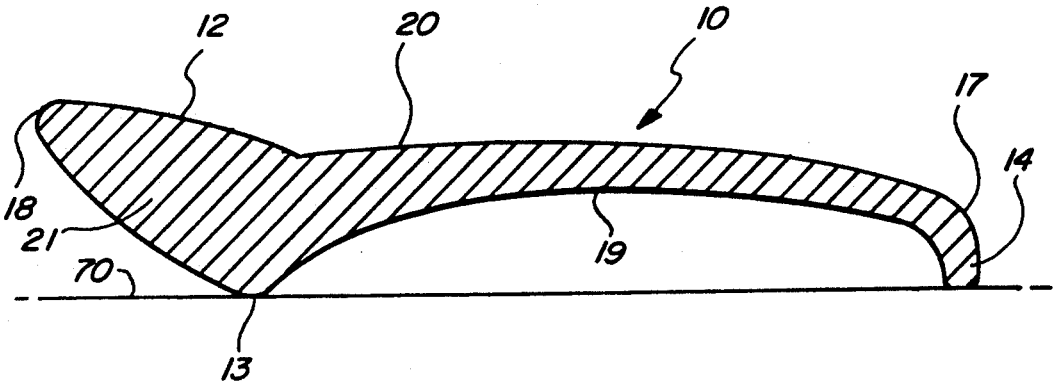
FIG. 3 sets forth a section view of the present invention exercise aid taken along section lines 3—3 in FIG. 1.

FIG. 3 sets forth a section view of the present invention exerciser taken along section lines 3—3 in FIG. 1.

Body 11 is preferably formed of a molded plastic material or the like and may be somewhat altered in configuration to suit the economies and desirabilities associated with the molding process. However, FIG. 3 sets forth a general section view in which the essential features of body 11 are set forth. Accordingly, body 11 defines a generally planar upper surface and a concave undersurface 19. As mentioned above, upper surface 20 is generally planar but, in its preferred form, is gently configured to provide an ergonomic-type surface for the user's body. In either event, body 11 defines a headrest portion 12, a top edge 19 and a bottom edge 17. The latter defines a downwardly extending lower stop 14. A triangular cross section pivot support 21 extends downwardly beneath headrest 12 and terminates in a transversely extending pivot edge 13. As will be apparent to skilled in the art, body 11 may be fabricated as a simple molded plastic unit or may alternatively be fabricated from other materials. In addition, body 11 may, in accordance with user preference, be covered with additional materials for providing the desired surface texture and characteristic. For example, body 11 may, if desired, be covered with a padded layer upon headrest 12 and upper surface 20 to increase the user's comfort.

Figure 4A:
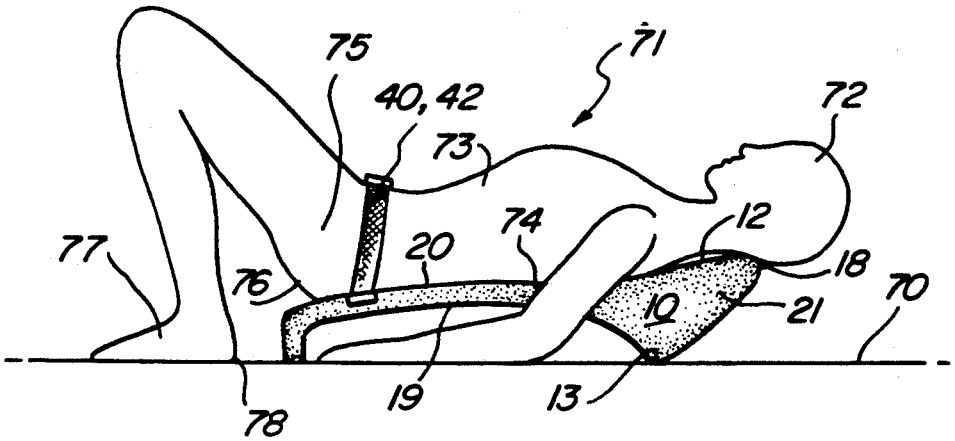
FIGS. 4A through 4C set forth sequential views of the present invention exercise aid in operation.
Figure 4B:
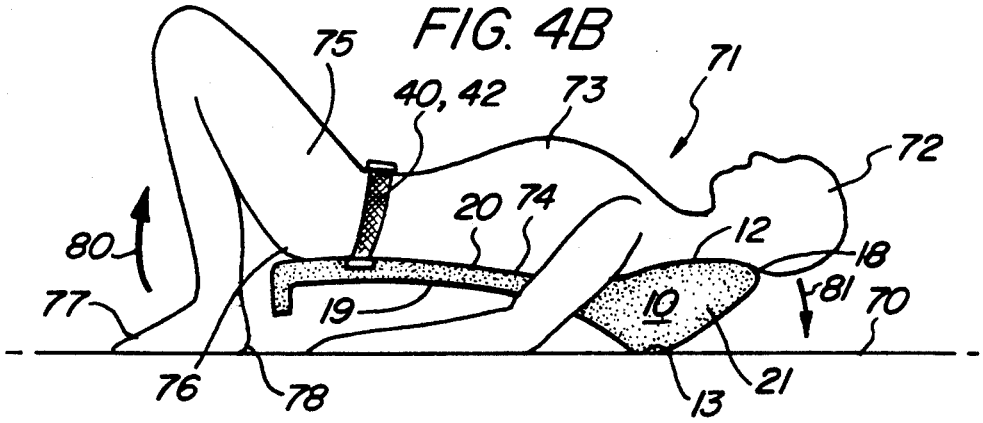
Figure 4C:
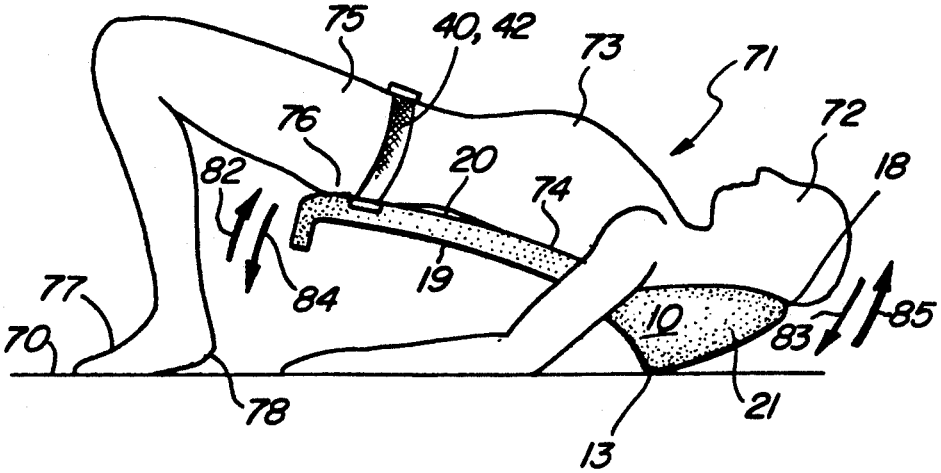

FIGS. 4A, 4B and 4C set forth sequential views of a typical use of the present invention exerciser. Specifically, with respect to FIG. 4A, exerciser 10 defines an upper surface 20, an undersurface 19, a bottom edge 17 and a top edge 18. Exerciser 10, as described above, further defines a headrest 12 and a downwardly extending pivot support 21 having a pivot edge 13. Bottom edge 17 defines a lower stop 14. In the position shown in FIG. 4A, exerciser 10 is resting upon a flat floor surface 70 and is supported entirely by pivot 13 and stop 14. A typical user, generally referenced by numeral 71, is supported upon exerciser 10 such that the user's head 72 is supported by headrest 12 and the user's torso 73 extends along upper surface 20 such that back 74 is received thereon. The user has hips 75 positioned near bottom edge 17 such that the user's buttocks 76 are positioned generally above and extending beyond bottom edge 17. In addition, as described above, user 71 has feet 77 flatly resting upon floor 70 such that heels 78 thereof are comfortably positioned near bottom edge 17 of exerciser 10. In addition, as mentioned above, user 71 has hands 79 resting upon floor surface 70. As is also mentioned above, as an alternative position, user 71 may grasp the side portions of exerciser 10 rather than resting hands upon floor 70. In either event, belts 40 and 41 are wrapped about the lower portion of torso 73 of user 71 in the general area of hips 75. Thus, in the position shown, user 71 is resting comfortably upon exerciser 10 and supported by floor 70. This position shown in FIG. 4A is the initial position of the exercise. Thereafter, the user bridges upwardly raising hips 75 and pressing feet 77 against floor 70 such that user 71's hips pivot upwardly in the direction indicated by arrow 80 in FIG. 4B. Correspondingly, due to the support of pivot 13 as stop 14 is raised from floor 70, headrest 12 pivots downwardly in the direction indicated by arrow 81. Thus, at the approximate midpoint of a typical exercise cycle, the user assumes the position shown in FIG. 4B. As the user continues to thrust hips 75 upwardly and bridge his or her body while supported by feet 77 upon floor 70, the pivotal motion of the user and exerciser 10 about pivot 13 continue until the user approaches the position shown in FIG. 4C.

Thus, in FIG. 4C, the user has pivoted hips 75 in the direction indicated by arrow 82 which in turn pivots head 72 downwardly in the direction indicated by arrow 83. FIG. 4C generally represents the maximum extension of a typical user. However, it will be apparent to those skilled in the art that the generally triangular cross-section structure of pivotal support 21 permits exerciser 10 to be further pivoted to a greater extension or wrestler's bridge position than that shown in FIG. 4C and thereby accommodate varying degrees of strength and flexibility by the user.

Once the desired extension has been attained, such as that shown in FIG. 4C, the user then relaxes and allows hips 75 to pivot downwardly in the direction indicated by arrow 84. This downward motion of hips 75 in turn pivots head 72 upwardly in the direction indicated by arrow 85 and allows user 71 to return to the initial position shown in FIG. 4A.

The above-described exercise cycle is repeated the desired number of times to provide strengthening and toning of the user's buttocks or gluteus muscle group. It will be apparent to those skilled in the art that the present invention exerciser provides a convenient, easy to use, and highly effective device for focusing exercise attention upon the buttocks or gluteus muscle group. The device shown has a minimum of components and, due to its low profile, may be easily stored beneath the user's bed or within closets or similar typical storage areas. In its preferred form, the present invention exerciser may be formed of a relatively inexpensive lightweight and strong molded plastic. Thus, the present invention exerciser may be fabricated in a manner which renders it easily washable.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is :

1. For use in the exercise and strengthening of the buttocks muscles by a human user, an exercise aid comprising:

a tilting device defining a generally rectangular planar member defining a pair of generally straight side edges each defining a plurality of slots therein having an upper surface, a generally concave undersurface, a head end, a bottom end and a downwardly extending pivot, said pivot being closer to said head end and said concave undersurface extending from said pivot to said bottom end and defining a downwardly extending stop member; and fastening means secured to said planar member for securing a portion of the human user to said upper surface including a pair of flexible straps each having a fixed end selectively coupled to a selected one of said slots to position said belts and securing means at the other end, said upper surface of said exercise aid defining a generally convex back supporting surface and a headrest at said head end for receiving and supporting a human resting face up upon said upper surface with head on one side of said pivot and hips on the other side and with said fastening means securing a portion of the lower torso of the user to the upper surface.

2. An exercise aid as set forth in claim 1 wherein said flexible straps are belts and wherein said securing means defines a removable buckle set.

3. An exercise aid as set forth in claim 1 wherein said flexible straps are belts and wherein said securing means defines cooperating hook and loop fabric attachment means.

4. An exercise aid as set forth in claim 1 wherein said upper surface defines a raised headrest.

5. An exercise aid as set forth in claim 1 wherein said tilting device is formed of an integral molded plastic unit.

6. For use in the exercise and strengthening of the buttocks muscles of a human user, an exercise aid comprising:

a tiltable body support having a generally planar upper surface defining first and second ends, a raised transverse headrest at said first end and a downwardly extending stop as said second end and generally parallel side edges;

a pivot extending downwardly from said tiltable body support and defining an edge proximate said headrest;

a pair of straps; and mulitple position strap attchment means for securing said straps to said side edges near said stop at a selected one of a plurality of positions, for securing the lower torso of a user's body to said tiltable member.

7. An exercise aid as set forth in claim 6 wherein said generally planar upper surface defines a slightly concave portion configured to rest a portion of a human torso.

8. An exercise aid as set forth in claim 7 wherein said strap attachment means define a plurality of slots formed in said side edges and means for attaching said flexible flat straps to said side edges at a plurality of positions corresponding to said slots.

* * * * *